US011142227B2

(12) United States Patent
Wang et al.

(10) Patent No.: US 11,142,227 B2
(45) Date of Patent: Oct. 12, 2021

(54) SIDE WALL COMPONENT OF RAILWAY VEHICLE, AND RAILWAY VEHICLE

(71) Applicant: CRRC QINGDAO SIFANG CO., LTD., Qingdao (CN)

(72) Inventors: Fei Wang, Qingdao (CN); Haiyang Yu, Qingdao (CN); Bo Song, Qingdao (CN); Honglei Tian, Qingdao (CN); Jianying Liang, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 448 days.

(21) Appl. No.: 16/197,488

(22) Filed: Nov. 21, 2018

(65) Prior Publication Data

US 2019/0084590 A1 Mar. 21, 2019

(30) Foreign Application Priority Data

Sep. 6, 2018 (CN) ..... 201811038299.4

(51) Int. Cl.
*B61D 27/00* (2006.01)
*B61D 17/08* (2006.01)

(52) U.S. Cl.
CPC ..... *B61D 27/009* (2013.01); *B61D 17/08* (2013.01)

(58) Field of Classification Search
CPC ..... B61D 27/009; B61D 17/08
See application file for complete search history.

(56) References Cited

U.S. PATENT DOCUMENTS 2,664,808 A * 1/1954 Peterson ..... B61D 27/009 454/105
2,839,080 A * 6/1958 Copeland ..... F23C 7/008 137/625.4
2,894,443 A * 7/1959 Rasmussen ..... B60H 1/242 454/127
2,902,917 A * 9/1959 Peterson ..... F24F 13/078 454/108
3,659,515 A * 5/1972 Galaniuk ..... B60H 1/3407 454/152
5,111,739 A * 5/1992 Hall ..... F24F 7/06 454/296
5,244,184 A * 9/1993 Larseneur ..... B60H 1/00692 251/294

(Continued)

FOREIGN PATENT DOCUMENTS

CN 2889816 Y 4/2007
CN 101544236 A 9/2009

(Continued)

*Primary Examiner* — Jason C Smith
(74) *Attorney, Agent, or Firm* — Cantor Colburn LLP

(57) ABSTRACT

Some embodiments of the present disclosure provide a side wall component of a railway vehicle, and a railway vehicle. The side wall component of a railway vehicle includes: a side wall, including a side wall body; and a plurality of side wall upright columns, connected with the side wall body respectively, the plurality of side wall upright columns being provided along a length direction of the side wall body at an interval, wherein an auxiliary air duct of the railway vehicle is formed between at least two side wall upright columns and the side wall body in the length direction of the side wall body. The embodiment of the present disclosure enables the railway vehicle to be compact in structure.

15 Claims, 5 Drawing Sheets

(56) References Cited

U.S. PATENT DOCUMENTS

| | | | | |
|---|---|---|---|---|
| 5,399,121 | A * | 3/1995 | Gray | B60H 1/245 454/137 |
| 8,764,526 | B2 * | 7/2014 | Hofler | B60H 1/262 454/83 |
| 8,808,075 | B2 * | 8/2014 | Gebke | B32B 3/10 454/297 |
| 9,457,638 | B2 * | 10/2016 | Hoefler | B61D 27/0072 |
| 9,599,362 | B2 * | 3/2017 | Leiterman | A01K 1/0047 |
| 2015/0166081 | A1 * | 6/2015 | Brendel | B61D 17/12 454/107 |
| 2019/0084590 | A1 * | 3/2019 | Wang | B61D 17/08 |
| 2019/0084591 | A1 * | 3/2019 | Wang | B61F 1/14 |
| 2019/0168781 | A1 * | 6/2019 | Song | B61D 17/08 |
| 2019/0168782 | A1 * | 6/2019 | Yu | B61D 1/00 |

FOREIGN PATENT DOCUMENTS

| | | | |
|---|---|---|---|
| CN | 204801785 | U | 11/2015 |
| CN | 106080629 | A | 11/2016 |
| CN | 106627616 | A | 5/2017 |
| CN | 206141556 | U | 5/2017 |
| CN | 107415965 | A | 12/2017 |
| CN | 107512279 | A | 12/2017 |
| CN | 107901932 | A | 4/2018 |
| CN | 208868038 | U | 5/2019 |
| JP | 2200563 | A | 8/1990 |

* cited by examiner

SIDE WALL COMPONENT OF RAILWAY VEHICLE, AND RAILWAY VEHICLE

CROSS REFERENCE TO RELATED APPLICATION

This application is related to and claims the benefit of Chinese Patent Application Number 201811038299.4 filed on Sep. 6, 2018, the contents of which are incorporated herein by reference in their entirety.

TECHNICAL FIELD

The present disclosure relates to a technical field of railway vehicles, and in particular to a side wall component of a railway vehicle, and a railway vehicle.

BACKGROUND

In the related art, a side wall of a railway vehicle is additionally provided with an air duct structure. The air duct structure is usually a rectangular box formed by welding or riveting a plurality of aluminum alloy sheets, and then the rectangular box is riveted to the side wall of the railway vehicle. Although this independent air duct structure can ensure the ventilation effect inside the railway vehicle, the above air duct structure increases a weight of a vehicle body of the railway vehicle, occupies an internal space or external space of the railway vehicle, and affects the overall structure of the entire railway vehicle.

SUMMARY

Some embodiments of the present disclosure provide a side wall component of a railway vehicle and a railway vehicle, intended to solve the problem in the related art of weight increase or volume increase of a railway vehicle caused by the arrangement of an additional air duct system on a side wall.

To this end, some embodiments of the present disclosure provide a side wall component of a railway vehicle. The side wall component of a railway vehicle includes: a side wall, including a side wall body; and a plurality of side wall upright columns, connected with the side wall body respectively, the plurality of side wall upright columns being provided along a length direction of the side wall body at an interval, wherein an auxiliary air duct communicated with a main air duct of a railway vehicle is formed between at least two of the plurality of side wall upright columns and the side wall body in the length direction of the side wall body.

Some embodiments of the present disclosure provide a railway vehicle. The railway vehicle includes a side wall component and a chassis component connected with the side wall component, the side wall component being the above side wall component.

By applying the embodiment of the present disclosure, a side wall body of a side wall and a side wall upright column are used to form an auxiliary air duct of a railway vehicle. Compared with the related art in which an air duct structure needs to be additionally provided and the additional air duct structure is welded or riveted to an exterior or interior of the side wall, the auxiliary air duct of an embodiment of the present disclosure is formed on the side wall and does not protrude from the side wall, and an external or internal space of the vehicle cannot be additionally occupied, so that the integrity of the railway vehicle is ensured, thereby avoiding from increasing the wind resistance in the running process of the railway vehicle due to the additional air duct structure or occupying the internal space of the vehicle. Both the side wall body and the side wall upright column are members of the side wall, and the arrangement cannot increase the weight of the side wall. Therefore, in the technical solution of the present application, the auxiliary air duct is directly formed on the side wall, thereby avoiding the problem of weight increase or volume increase or internal space reduction of the railway vehicle, so that the overall structure of the railway vehicle is compact.

BRIEF DESCRIPTION OF THE DRAWINGS

The accompanying drawings, which constitute a part of this application, are used to provide a further understanding of the present disclosure, and the exemplary embodiments of the present disclosure and the description thereof are used to explain the present disclosure, but do not constitute improper limitations to the present disclosure. In the drawings.

The drawings include the following reference signs:

70: side wall; 701: side wall body; 702: air duct opening; 703: under-window cross beam; 710: side wall upright column; 7101: first folded edge; 7102: second folded edge; 7103: vertical edge; 7104: avoidance groove; 73: vehicle window; 78: inner cover plate; 79: reinforcing cross beam; 791: first reinforcing cross beam; 791*a*: flange structure; 792: second reinforcing cross beam.

DETAILED DESCRIPTION OF THE EMBODIMENTS

It is to be noted that in the case of no conflict, the features in the embodiments and the embodiments in the present application may be combined with each other. The present disclosure is described below with reference to the drawings and in conjunction with the embodiments in detail.

Figure 1:
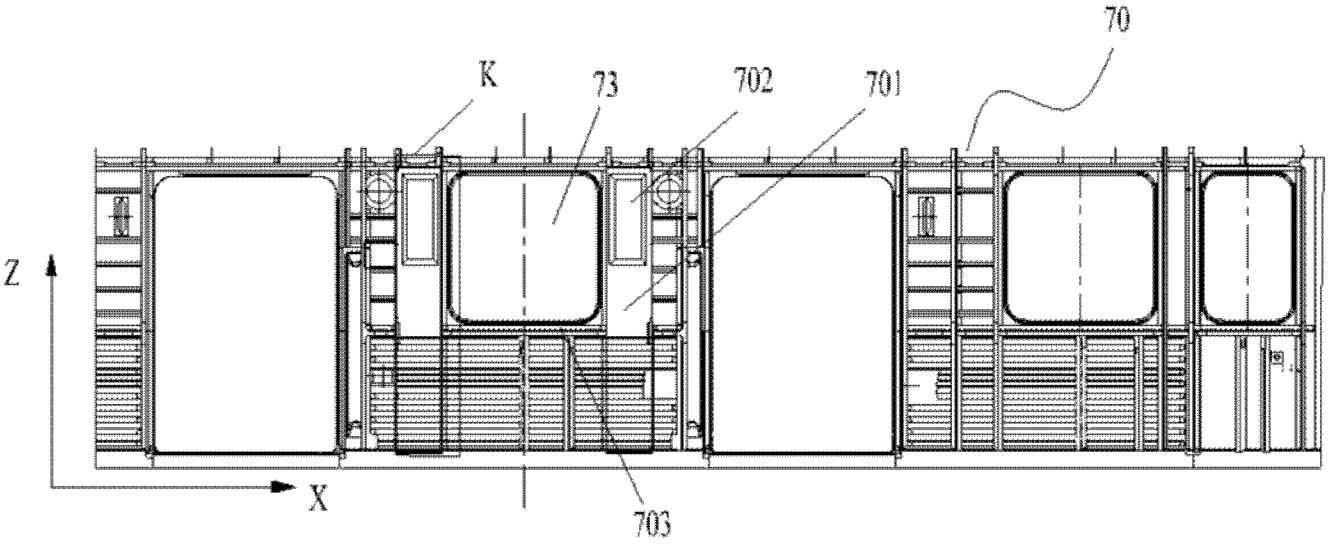
FIG. 1 illustrates a structural schematic diagram of a side wall component of a railway vehicle according to an embodiment of the present disclosure.

In the present disclosure and the embodiments of the present disclosure, as shown in FIG. 1, a length direction of a side wall component 701 is an X direction, and a width direction of the side wall component 701 is a Z direction.

Figure 2:
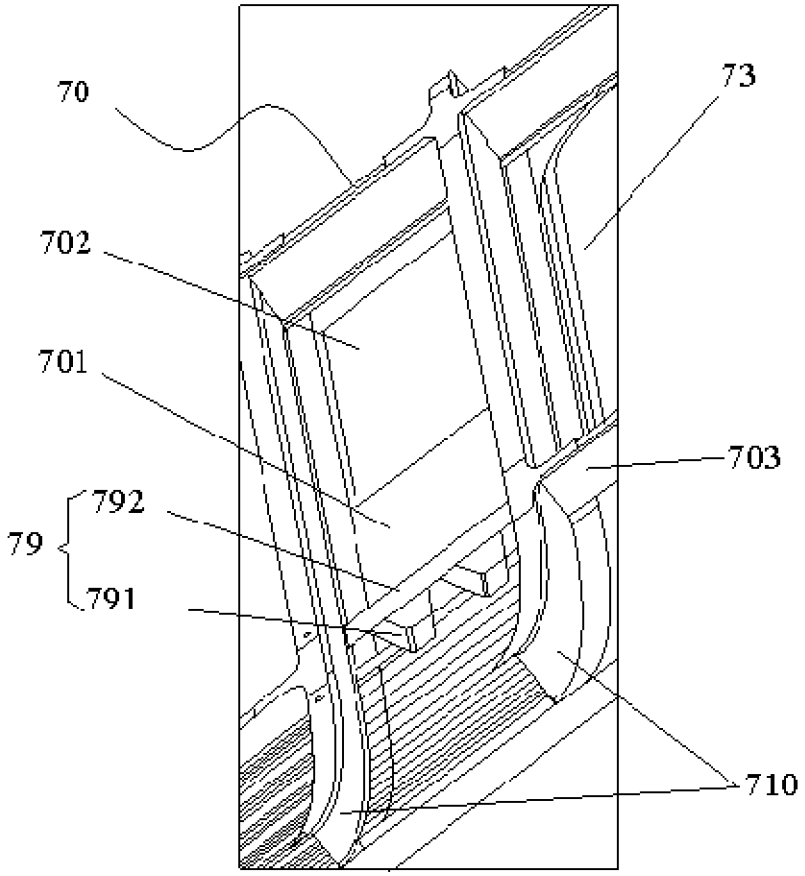
FIG. 2 illustrates a stereo-structure schematic diagram of the side wall component in FIG. 1 after a part K rotates for a certain angle (where a reinforcing cross beam is illustrated)

As shown in FIG. 1 and FIG. 2, an embodiment of the present disclosure provides a side wall component of a railway vehicle. The side wall component of the present embodiment includes a side wall 70 and a plurality of side wall upright columns 710. The side wall 70 includes a side wall body 701. The plurality of side wall upright columns 710 are connected with the side wall body 701 respectively, and the plurality of side wall upright columns 710 are provided along a length direction of the side wall body 701 at an interval, wherein an auxiliary air duct communicated with a main air duct of a railway vehicle is formed between at least two of the plurality of side wall upright columns 710 and the side wall body 701 in the length direction of the side wall body 701.

In the embodiment of the present disclosure, the side wall body 701 of the side wall 70 and the side wall upright columns 710 are used to form the auxiliary air duct of the railway vehicle. Compared with the related art in which an air duct structure needs to be additionally provided and the additional air duct structure is welded or riveted to an exterior of the side wall 70 or an interior of the side wall 70, the auxiliary air duct of the present embodiment is formed on the side wall 70 and does not protrude from the side wall 70, and an external or internal space of the vehicle cannot be additionally occupied, so that the integrity of the railway vehicle is ensured, thereby avoiding from increasing the wind resistance in the running process of the railway vehicle due to the additional air duct structure or occupying the internal space of the vehicle. Both the side wall body 701 and the side wall upright columns 710 are members of the side wall 70, and the arrangement cannot increase the weight of the side wall 70. Therefore, the auxiliary air duct is formed on the side wall 70, thereby avoiding the problem of weight increase or volume increase of internal space reduction of the railway vehicle, so that the overall structure of the railway vehicle is compact.

In an exemplary embodiment, the auxiliary air duct is formed on the side wall 70, that is to say, the auxiliary air duct having a hollow structure is formed on the side wall 70, and the auxiliary air duct passes through a height direction of the side wall body 701, so that on the premise of meeting the internal ventilation of the railway vehicle, the weight of the vehicle body is reduced, and the light weight of the railway vehicle is realized.

Moreover, the main air duct is communicated with the auxiliary air duct, so that air in the entire railway vehicle circulates, thereby ensuring the circulation of air inside the railway vehicle, and improving the user experience.

Figure 5:
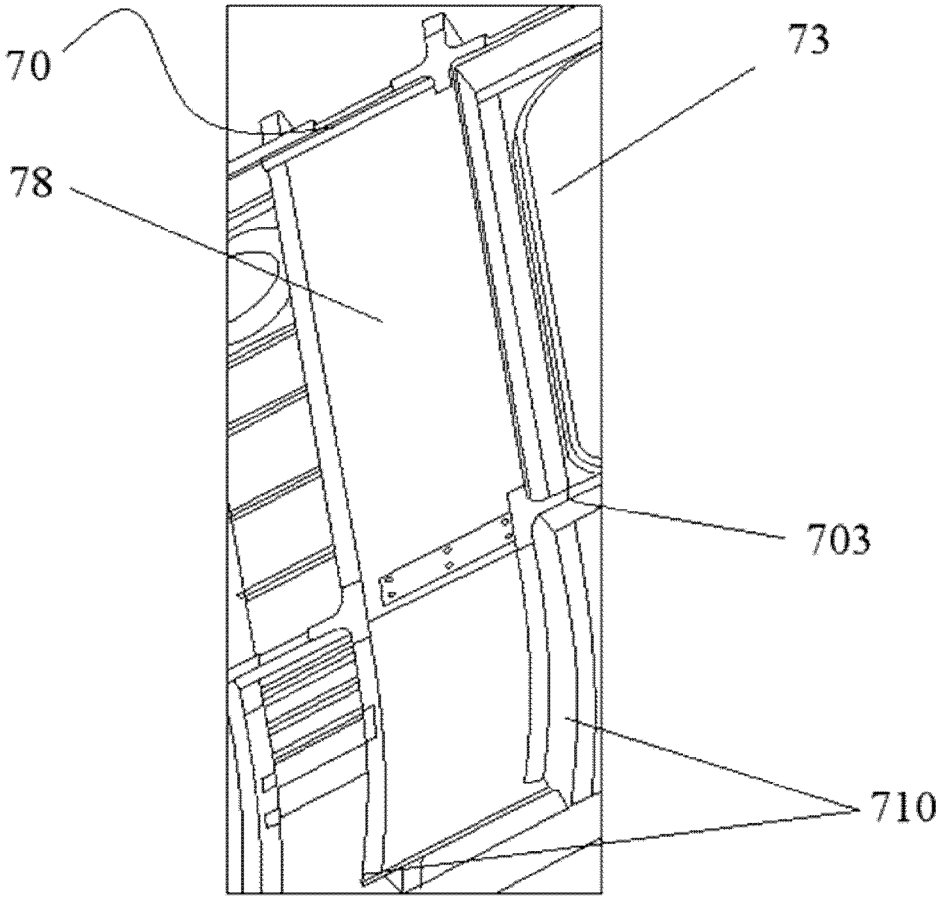
FIG. 5 illustrates a stereo-structure schematic diagram of the side wall component in FIG. 1 after a part K rotates for a certain angle (where an inner cover plate is illustrated)

As shown in FIG. 2 and FIG. 5, in an exemplary embodiment of the present disclosure, the side wall component further includes a vehicle window 73 provided on the side wall body 701, at least two side wall upright columns 710 in the plurality of side wall upright columns 710 are located on a same side of the vehicle window 73.

In an exemplary embodiment, the auxiliary air duct is provided on the two side wall upright columns 710 located on the same side of the vehicle window 73. In the present embodiment, an under-window cross beam is not provided between the two side wall upright columns 710 located on the same side of the vehicle window 73. Thus, the two side wall upright columns 710 and the side wall body 701 can be fully utilized to form an air duct, the entire auxiliary air duct can be kept to be smooth, and the ventilation effect of the auxiliary air duct is ensured.

Figure 3:
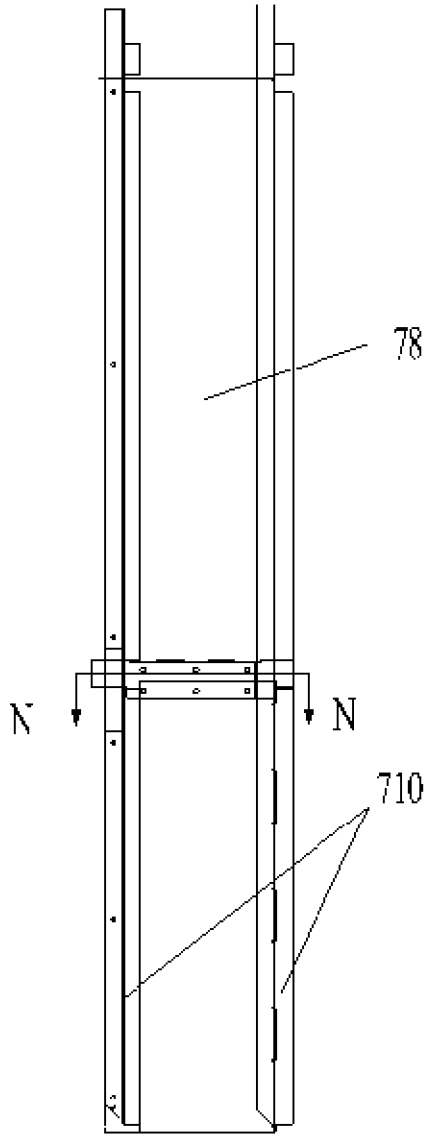
FIG. 3 illustrates a plane structure schematic diagram of a part K of the side wall component in FIG. 1 (where an inner cover plate is illustrated)

As shown in FIG. 3 and FIG. 5, in an exemplary embodiment of the present disclosure, the side wall component further includes an inner cover plate 78, wherein the inner cover plate 78 is provided on the at least two side wall upright columns 710 located on the same side of the vehicle window 73, and the inner cover plate 78, the at least two side wall upright columns 710 and the side wall body 701 jointly form the auxiliary air duct.

In an exemplary embodiment, the inner cover plate 78 covers the at least two side wall upright columns 710, so that the inner cover plate 78, the at least two side wall upright columns 710 and the side wall body 701 form an auxiliary air duct running through the side wall 70 along the height direction of the side wall body 701. The entire auxiliary air duct is simple in structure and convenient for connection, and does not occupy the internal space of the vehicle.

Of course, in an alternative embodiment not illustrated in the drawings of the present disclosure, only the two side wall upright columns 710 and the side wall body 701 may also form an auxiliary air duct, and a person skilled in the art may improve the structure of the side wall upright columns 710 as required to form the needed auxiliary air duct, so that the auxiliary air duct is formed on the side wall 70, as long as the structure in the inventive concept of the present application is improved within the scope of protection of the present application.

Figure 4:
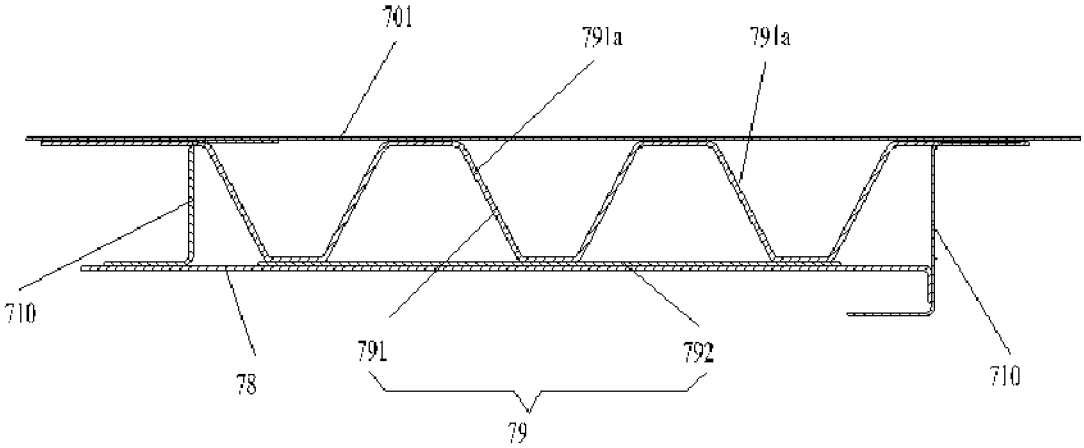
FIG. 4 illustrates an N-N direction sectional view of the side wall component in FIG. 3.

As shown in FIG. 2 and FIG. 4, in an exemplary embodiment of the present disclosure, the side wall component further includes a reinforcing cross beam 79 located in the auxiliary air duct, two opposite ends of the reinforcing cross beam 79 are correspondingly connected with the at least two side wall upright columns 710.

In the present application, in order to ensure the structural strength of the auxiliary air duct part on the side wall 70, the reinforcing cross beam 79 is provided in the auxiliary air duct so as to match the overall strength of the entire side wall 70, thereby avoiding local damage to the entire side wall 70 caused by insufficient local strength.

In an exemplary embodiment, two opposite ends of the reinforcing cross beam 79 are correspondingly connected with the two side wall upright columns 710 along the length direction of the side wall body 701, so as to ensure the connecting strength of the reinforcing cross beam 79 in the auxiliary air duct, thereby avoiding the separation of the reinforcing cross beam 79.

As shown in FIG. 2 and FIG. 4, in an exemplary embodiment of the present disclosure, the reinforcing cross beam 79 includes a first reinforcing cross beam 791 connected with the side wall body 701, and the first reinforcing cross beam 791 is provided with a transitional air duct communicated with the auxiliary air duct.

In the embodiment of the present disclosure, it is necessary to consider the air circulation of the entire auxiliary air duct to provide the reinforcing cross beam 79. Therefore, the reinforcing cross beam 79 in the embodiment of the present disclosure includes a first reinforcing cross beam 791 having a transitional air duct. The arrangement not only ensures the structural strength of the auxiliary air duct on the side wall 70, but also ensures the circulation of air in the auxiliary air duct.

As shown in FIG. 2 and FIG. 4, in an exemplary embodiment of the present disclosure, the reinforcing cross beam 79 further includes a second reinforcing cross beam 792, the second reinforcing cross beam 792 is connected with the first reinforcing cross beam 791 and located between the first reinforcing cross beam 791 and the inner cover plate 78, wherein a part of the transitional air duct is enclosed between the second reinforcing cross beam 792 and the first reinforcing cross beam 791, and the remaining part of the transitional air duct is enclosed between the side wall body 701 and the first reinforcing cross beam 791.

In an exemplary embodiment, a part of the second reinforcing cross beam 792 is connected with a part of the first reinforcing cross beam 791, and a part of the first reinforcing cross beam 791 is connected with the side wall body 701. The provision of the transitional air duct ensures the auxiliary air duct pass through the side wall 70 in the height direction of the side wall 70, and ensures the ventilation effect of the auxiliary air duct.

As shown in FIG. 2 and FIG. 4, in an exemplary embodiment of the present disclosure, the first reinforcing cross beam 791 includes spaced plurality of flange structures, the plurality of flange structures are provided at an interval, an inner wall surface of each of the plurality of flange structures and the inner side of the second reinforcing cross beam 792 forming the transitional air duct.

In an exemplary embodiment, the first reinforcing cross beam 791 is provided with a flange structure 791*a* of which the cross section is trapezoidal. The structure of the first reinforcing cross beam 791 in FIG. 4 is taken as an example. The inner wall surface of each flange structure 791*a* and the inner side of the second reinforcing cross beam 792 form the part of the transitional air duct, and spacing between two adjacent flange structures 791*a* and the inner side of the side wall body 701 form another part of the transitional air duct.

The arrangement ensures communication of the transitional air duct and the auxiliary air duct, so that the ventilation of the auxiliary air duct is smooth. Moreover, the strength of the first reinforcing cross beam 791 having the flange structure is good, and the structural strength of the side wall 70 forming the auxiliary air duct is ensured.

In an exemplary embodiment, the first reinforcing cross beam 791 is made of a metal plate by using a bending process. As shown in FIG. 4, the trapezoidal flange structure 791*a* is provided with an upper bottom and a lower bottom, the upper bottom of the flange structure 791*a* is connected with the side wall body 701, and the lower bottom of the flange structure 791*a* is connected with the second reinforcing cross beam 792. By providing the second reinforcing cross beam 792, the connecting area between the reinforcing cross beam 79 and the inner cover plate 78 is increased, and the connecting strength between the reinforcing cross beam 79 and the inner cover plate 78 is improved.

Of course, in an alternative embodiment not illustrated in the drawings of the present disclosure, the shape of the cross section of the flange structure 791*a* of the first reinforcing cross beam 791 is not limited to trapezoid, and may be triangle, rectangle, arc or the like.

In an exemplary embodiment, the first reinforcing cross beam 791 is welded to the side wall body 701, and the first reinforcing cross beam 791 is welded to the second reinforcing cross beam 792.

The welding connection strength is good, thereby ensuring the own structural strength of the reinforcing cross beam 79 and the connecting strength between the reinforcing cross beam 79 and the side wall body 701. A sealant is coated on the welding joint between the first reinforcing cross beam 791 and the side wall body 701, and a sealant is also coated on the welding joint between the first reinforcing cross beam 791 and the second reinforcing cross beam 792, so as to fill a gap at the welding joint, thereby ensuring the own structural strength of the reinforcing cross beam 79 and the connecting strength between the reinforcing cross beam 79 and the side wall body 701, and further ensuring that the strength of the side wall body 701 provided at the auxiliary air duct matches the overall strength of the entire side wall 70.

Figure 6:
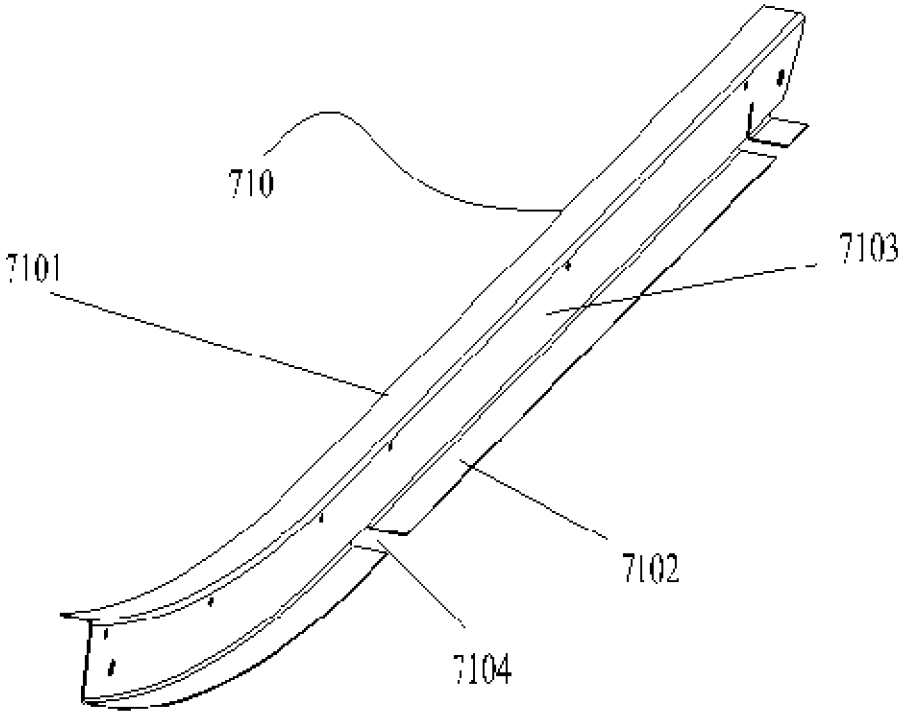
FIG. 6 illustrates a stereo-structure schematic diagram of a side wall upright column of the side wall component in FIG. 2.

As shown in FIG. 4 and FIG. 6, in an exemplary embodiment of the present disclosure, the side wall upright column 710 includes a first folded edge 7101, a second folded edge 7102 opposite to the first folded edge 7101, and a vertical edge 7103 connecting the first folded edge 7101 and the second folded edge 7102, the first folded edge 7101 is connected with the inner cover plate 78, and the second folded edge 7102 is connected with the side wall body 701.

In an exemplary embodiment, the first folded edge 7101 and the second folded edge 7102 are provided on two sides of the vertical edge 7103, and the first folded edge 7101 and the second folded edge 7102 are parallel to each other. The first folded edge 7101 is welded to the inner cover plate 78, and the second folded edge 7102 is welded to the side wall body 701.

By means of the arrangement, the side wall body 701, the side wall upright column 710 and the inner cover plate 78 are connected to form the entire auxiliary air duct, and the connecting strength is good.

In an exemplary embodiment, as shown in FIG. 4 and FIG. 6, the second folded edge 7102 is provided with an avoidance groove 7104 for allowing the first reinforcing cross beam 791 to pass through.

In the present application, a part of the first reinforcing cross beam 791 is welded to the side wall body 701, and the second folded edge 7102 is provided with an avoidance groove 7104 for allowing the first reinforcing cross beam 791 to pass through, so as to connect the first reinforcing cross beam 791 and the side wall body 701.

Optionally, two opposite ends of the first reinforcing cross beam 791 are sandwiched between the side wall body 701 and the side wall upright column 710, so that the mounting strength between the first reinforcing cross beam 791 and the side wall body 701 is ensured, thereby ensuring the structural strength of the auxiliary air duct.

As shown in FIG. 4 and FIG. 5, in an exemplary embodiment of the present disclosure, one end of the inner cover plate 78 is connected with the first folded edge 7101 of at least one side wall upright column 710 in the at least two side wall upright columns 710, the other end of the inner cover plate 78 is provided with a bending portion, and the bending portion is connected with a vertical edge 7103 of at least the other side wall upright column 710 in the at least two side wall upright columns 710.

In an exemplary embodiment, the inner cover plate 78 covers the two side wall upright columns 710, the first end of the inner cover plate 78 is welded to the first folded edge 7101 of one of the side wall upright columns, the second end of the inner cover plate 78 is provided with a bending portion, the bending portion bends toward the first folded edge 7101, and the bending portion is welded to the vertical edge 7103 of the other side wall upright column 710. The arrangement ensures the connecting strength between the inner cover plate 78 and the side wall upright column 710, and further ensures the integrity of the entire auxiliary air duct.

In an exemplary embodiment, the inner cover plate 78 is also welded to the second reinforcing cross beam 792. By providing the second reinforcing cross beam 792, the overall contact area between the inner cover plate 78 and the reinforcing cross beam 79 is increased, thus ensuring the mounting strength of the inner cover plate 78.

Of course, in an alternative embodiment not illustrated in the drawings of the present disclosure, the bending portion may also bend toward the second folded edge 7102, and the bending portion may be welded to the vertical edge 7103; or, the inner cover plate 78 may not be provided with a bending portion, so that the vertical edges 7103 of the two side wall upright columns 710 have the same width, and the second end of the inner cover plate 78 is directly welded to the first folded edge 7101 of the other side wall upright column 710.

The above connection mode may realize the connection between the inner cover plate 78 and the side wall upright column 710.

As shown in FIG. 1 and FIG. 2, in an exemplary embodiment of the present disclosure, the side wall body 701 is provided with an air duct opening 702 communicated with the auxiliary air duct, and the air duct opening 702 is located above the reinforcing cross beam 79 along the height direction of the side wall body 701.

The arrangement enables air to flow into the auxiliary air duct from the air duct opening, thereby ensuring the air source of the auxiliary air duct. Further, in the railway vehicle of the present application, the side wall body 701 above the reinforcing cross beam 79 is a common metal plate structure, and the side wall body 701 below the reinforcing cross beam 79 is a corrugated plate structure. Therefore, the air duct opening 702 is provided above the reinforcing cross beam 79 conveniently, so as to avoid the structural strength of the side wall body 701 from being affected by provision of the air duct opening on the corrugated plate structure.

As shown in FIG. 1, FIG. 2 and FIG. 5, in an exemplary embodiment of the present disclosure, the side wall component further includes an under-window cross beam 703, the under-window cross beam 703 is located at the lower part of the vehicle window 73.

In the related art, the under-vehicle window cross beam extends up along the length direction of the side wall body, and extends to two adjacent door frames from the lower part of the vehicle window to two ends, so as to improve the strength of the side wall body in the length direction. Since the under-window cross beam is a closed structure, the arrangement mode of the under-window cross beam cannot form an air duct on the side wall body. In the embodiment of the present disclosure, the under-window cross beam 703 is only provided at the lower part of the vehicle window 73, thereby ensuring the penetration of the auxiliary air duct in the height direction of the side wall 701, and ensuring the ventilation effect of the auxiliary air duct.

The embodiment of the present disclosure also provides a railway vehicle. The railway vehicle of the present embodiment includes a side wall component and a chassis component connected with the side wall component, the side wall component being the above side wall component.

According to the side wall component of the present application, the auxiliary air duct of the railway vehicle is formed by using the own side wall body 701 and the side wall upright column 710, and the auxiliary air duct does not protrude from the side wall, so that the external space of the vehicle cannot be additionally occupied, thereby ensuring the integrity of the railway vehicle, and avoiding from increasing the wind resistance of the railway vehicle in the running process by the additional air duct system. Therefore, the railway vehicle having the above side wall component also has the above advantages.

From the above description, it can be seen that the above embodiment of the present disclosure achieves the following technical effects: a side wall body of a side wall and a side wall upright column are used to form an auxiliary air duct of a railway vehicle. Compared with the related art in which an air duct system needs to be additionally provided and the additional air duct system is welded or riveted to the exterior of the side wall, the auxiliary air duct of the embodiment in the present disclosure is formed on the side wall and does not protrude from the side wall, and the external space of the vehicle cannot be additionally occupied, so that the integrity of the railway vehicle is ensured, thereby avoiding from increasing the wind resistance in the running process of the railway vehicle due to the additional air duct system. Both the side wall body and the side wall upright column are members of the side wall, and the arrangement cannot increase the weight of the side wall. Therefore, by means of the arrangement, the auxiliary air duct is formed on the side wall, thereby avoiding the problem of weight increase or volume increase of the railway vehicle, so that the overall structure of the railway vehicle is compact.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A side wall component of a railway vehicle, comprising:

a side wall, comprising a side wall body; and a plurality of side wall upright columns, connected with the side wall body respectively, the plurality of side wall upright columns being provided along a length direction of the side wall body at an interval, wherein an auxiliary air duct communicated with a main air duct of the railway vehicle is formed between at least two of the plurality of side wall upright columns and the side wall body in the length direction of the side wall body;

wherein the side wall component further comprises:

a vehicle window provided on the side wall body, at least two of the plurality of side wall upright columns being located on a same side of the vehicle window;

an inner cover plate, wherein the inner cover plate is provided on the at least two of the plurality of side wall upright columns located on the same side of the vehicle window, and the inner cover plate, the at least two of the plurality of side wall upright columns and the side wall body jointly form the auxiliary air duct; and a reinforcing cross beam provided in the auxiliary air duct, two opposite ends of the auxiliary air duct being correspondingly connected with two side wall upright columns in the plurality of side wall upright columns.

2. The side wall component as claimed in claim 1, wherein the reinforcing cross beam comprises a first reinforcing cross beam connected with the side wall body, and the first reinforcing cross beam is provided with a transitional air duct communicated with the auxiliary air duct.

3. The side wall component as claimed in claim 2, further comprising an under-window cross beam, the under-window cross beam being located at a lower part of the window.

4. The side wall component as claimed in claim 2, wherein the side wall body is provided with an air duct opening communicated with the auxiliary air duct, and the air duct opening is located above the reinforcing cross beam along a height direction of the side wall body.

5. The side wall component as claimed in claim 2, wherein the reinforcing cross beam further comprises a second reinforcing cross beam, the second reinforcing cross beam being connected with the first reinforcing cross beam and located between the first reinforcing cross beam and the inner cover plate, wherein a part of the transitional air duct is enclosed between the second reinforcing cross beam and the first reinforcing cross beam, and/or, a rest part of the transitional air duct is enclosed between the side wall body and the first reinforcing cross beam.

6. The side wall component as claimed in claim 5, wherein each of the side wall upright columns comprises a first folded edge, a second folded edge opposite to the first folded edge, and a vertical edge connecting the first folded edge and the second folded edge, the first folded edge being connected with the inner cover plate, and the second folded edge being connected with the side wall body.

7. The side wall component as claimed in claim 5, further comprising an under-window cross beam, the under-window cross beam being located at a lower part of the window.

8. The side wall component as claimed in claim 5, wherein the first reinforcing cross beam comprises a plurality of flange structures, the plurality of flange structures being provided at an interval, an inner wall surface of each of the plurality of flange structures and an inner side of the second reinforcing cross beam forming the transitional air duct.

9. The side wall component as claimed in claim 5, wherein the first reinforcing cross beam is welded to the side wall body, and/or, the first reinforcing cross beam is welded to the second reinforcing cross beam.

10. The side wall component as claimed in claim 2, wherein each of the side wall upright columns comprises a first folded edge, a second folded edge opposite to the first folded edge, and a vertical edge connecting the first folded edge and the second folded edge, the first folded edge being connected with the inner cover plate, and the second folded edge being connected with the side wall body.

11. The side wall component as claimed in claim 10, wherein the second folded edge is provided with an avoidance groove for avoiding the first reinforcing cross beam.

12. The side wall component as claimed in claim 10, wherein one end of the inner cover plate is connected with the first folded edge of at least one side wall upright column in the at least two side wall upright columns, the other end of the inner cover plate is provided with a bending portion, and the bending portion is connected with the vertical edge of at least the other side wall upright column in the at least two side wall upright columns.

13. The side wall component as claimed in claim 1, wherein the side wall body is provided with an air duct opening communicated with the auxiliary air duct, and the air duct opening is located above the reinforcing cross beam along a height direction of the side wall body.

14. The side wall component as claimed in claim 1, further comprising an under-window cross beam, the under-window cross beam being located at a lower part of the window.

15. A railway vehicle, comprising a side wall component and a chassis component connected with the side wall component, wherein the side wall component is the side wall component as claimed in claim 1.

* * * * *